US010046360B2

(12) United States Patent
Lee et al.

(10) Patent No.: US 10,046,360 B2
(45) Date of Patent: Aug. 14, 2018

(54) METHOD FOR MANUFACTURING ALUMINUM ELECTRODE USING SOLUTION PROCESS

(75) Inventors: Hye Moon Lee, Gyeongsangnam-do (KR); Dong-Won Lee, Seoul (KR); Jung-Yeul Yun, Gyeongsangnam-do (KR)

(73) Assignee: Korea Institute of Machinery and Materials, Daejeon (KR)

( * ) Notice: Subject to any disclaimer, the term of this patent is extended or adjusted under 35 U.S.C. 154(b) by 442 days.

(21) Appl. No.: 13/637,235

(22) PCT Filed: Dec. 8, 2010

(86) PCT No.: PCT/KR2010/008761

§ 371 (c)(1),
(2), (4) Date: Sep. 25, 2012

(87) PCT Pub. No.: WO2012/063991

PCT Pub. Date: May 18, 2012

(65) Prior Publication Data

US 2013/0213690 A1 Aug. 22, 2013

(30) Foreign Application Priority Data

Nov. 11, 2010 (KR) ..... 10-2010-0112091

(51) Int. Cl.
*B05D 5/12* (2006.01)
*C23C 18/10* (2006.01)
(Continued)

(52) U.S. Cl.
CPC ..... *B05D 5/12* (2013.01); *C23C 18/10* (2013.01); *B05D 1/02* (2013.01); *B05D 1/286* (2013.01); *B05D 3/02* (2013.01); *B05D 3/12* (2013.01)

(58) Field of Classification Search
USPC ..... 427/123, 126.1, 383.1
See application file for complete search history.

(56) References Cited

U.S. PATENT DOCUMENTS 2,547,371 A * 4/1951 Brennan ..... 361/528
4,490,409 A * 12/1984 Nablo ..... 427/505
(Continued)

FOREIGN PATENT DOCUMENTS

JP 2006-66243 A 3/2006
KR 2000-51435 A 8/2000
(Continued)

OTHER PUBLICATIONS

Machine Translation of KR 10-2010-0111411.*

*Primary Examiner* — Brian K Talbot
(74) *Attorney, Agent, or Firm* — Bachman & LaPointe, PC

(57) ABSTRACT

The present invention provides a method for manufacturing an aluminum electrode using a solution process and an aluminum electrode manufactured thereby. The manufacturing method includes the steps of: manufacturing an aluminum precursor solution for the solution processing using $AlH_3$ as a basic material before forming aluminum; coating the aluminum precursor solution on a substrate through the solution process and drying the aluminum precursor solution; and forming a low work function aluminum electrode through a low-temperature baking process at the temperature of at most 150° C. The method for manufacturing the aluminum electrode according to the present invention improves a thermal defect of the electrode due to a high-temperature baking process, prevents excessive loss of raw materials, and can manufacture aluminum electrodes of various sizes with area ranging from small to large at relatively low costs and by a simple process under atmospheric pressure.

4 Claims, 7 Drawing Sheets

(51) Int. Cl.

| | |
|---|---|
| *B05D 1/02* | (2006.01) |
| *B05D 3/12* | (2006.01) |
| *B05D 3/02* | (2006.01) |
| *B05D 1/28* | (2006.01) |

(56) References Cited

U.S. PATENT DOCUMENTS

| | | | | |
|---|---|---|---|---|
| 4,882,232 | A * | 11/1989 | Bugnet et al. | 428/613 |
| 5,855,716 | A * | 1/1999 | Tonucci | H01L 21/4846 156/230 |
| 6,562,539 | B1 * | 5/2003 | Chatow | G03G 15/161 399/297 |
| 2006/0057827 | A1 * | 3/2006 | Huhtasalo | G06K 19/07779 438/584 |
| 2007/0211128 | A1 * | 9/2007 | Parker | B41J 2/0057 347/103 |
| 2008/0217819 | A1 * | 9/2008 | Lee | B29C 37/0067 264/446 |
| 2010/0022078 | A1 * | 1/2010 | Rockenberger et al. | 438/585 |

FOREIGN PATENT DOCUMENTS

| | | | |
|---|---|---|---|
| KR | 10-0512771 | B | 9/2005 |
| KR | 10-0795305 | B | 1/2008 |
| KR | 2010-111411 | A | 10/2010 |

* cited by examiner (A) example 1

(B) example 2

(C) example 3

(A) AL ELECTRODE FORMED ON GLASS SUBSTRATE IN EMBODIMENT 1

(B) AL ELECTRODE FORMED ON GLASS SUBSTRATE IN EMBODIMENT 2

(C) AL ELECTRODE FORMED ON GLASS SUBSTRATE IN EMBODIMENT 3

METHOD FOR MANUFACTURING ALUMINUM ELECTRODE USING SOLUTION PROCESS

CROSS-REFERENCES TO RELATED APPLICATIONS

This patent application is a U.S. national phase under 35 U.S.C 371 of PCT/KR2010/008761 filed on Dec. 8, 2010, which claims the benefit of priority from Korean Patent Applications No. 10-2010-0112901, filed on November 11, the contents of which are incorporated herein by reference in its entirety.

BACKGROUND OF THE INVENTION

1. Field of the Invention

The present invention relates to a method for manufacturing an aluminum electrode using a solution process and an aluminum electrode using the same.

2. Description of the Related Art

Aluminum with a low work function is generally used as a material for a cathode of an environmental energy device requiring ohmic contact, such as solar cells and OLEDs.

Due to rapid oxidization characteristic, aluminum electrodes, used as a material for a cathode of organic solar cells and OLED devices, are manufactured using thermal evaporation and sputter coating in a vacuum.

The thermal evaporation is a method in which a crucible formed of ceramic is heated by using electric heat and a material is evaporated to the crucible to form a film. Generally, a point source with a high temperature may be used for evaporating metal electrodes such as Mg—Al, Al—Li, and Al, with electric heat. In order to form a metal cathode, there is required a temperature of 1300° C., whose efficiency of using a material is 30% or less. A processing condition described above causes excessive loss of raw material and a deterioration of organics, and aluminum with a high-temperature, on a wall of a ceramic crucible, creeps over the crucible due to a great wetting angle between aluminum and ceramic, thereby reducing a replacement cycle and increasing cost of maintaining equipment.

Also, sputter coating is a method in which electrons generated by applying a negative bias to a sputter gun in a vacuum system disassociate an inactive gas and generate plasma and ion particles with high energy generated thereby collide with a surface of a target where ion particles are to be evaporated to and exchange kinetic energy in such a way that atoms or molecules bounce out of the surface and are absorbed onto a substrate. The sputter coating has a problem in which collision of particles with energy generates defects and forms local trap sites, thereby causing a structural organic distortion of an organic film. Also, the collision elevates a temperature of the surface and deteriorates properties of an organic layer.

To solve problems as described above, Plasma Process. Polym. 2009, 6, S808 discloses a method for reducing a defect of an organic layer by adjusting a voltage applied to a DC magnetron. Also, in Applied Physics Letters 88, 083513 (2006) and J. KIEEME Vol. 85, No. 19, 8 (2004), a defect of an organic layer is prevented by using a mixture gas of Ar and Kr for sputtering. However, methods described above have a difficulty in manufacturing electrodes with a large area.

Korean Patent Publication No. 2010-0111411 discloses an aluminum electrode paste and a solar cell using the same. According to a description thereof, the aluminum electrode paste includes three types of aluminum powder whose particle size is different from one another, glass frit, and an organic binder. The paste effectively forms a back surface field by increasing an area in contact with a silicon wafer and a diffusion area, improves electrical properties by mixing particles whose size is different from one another to increase filling density of the aluminum powder, and reducing a shrinkage factor of particles by reducing thermal expansion of metal elements in a thermal process. However, to dry the paste, the method includes a first heating with 80 to 200° C. and a second heating with 700 to 900° C., thereby causing a thermal defect of an organic layer.

Recently, there has been researched a method for improving a sputtering process in order to mass-produce large sized organic light emitting diodes. For example, there is a method for forming an aluminum cathode of an OLED without a defect of plasma by using mirror shape target sputtering (MSTS) disclosed in 19p of Applied physics letters Vol. 85 (2004). Also, there is an example of coating a substrate of 20×20 by amending the method.

However, as described above, according to the thermal evaporation method and sputtering method, there is caused excessive loss of material, is required a heavy charge for manufacturing and maintaining evaporation facilities, and is a difficulty in manufacturing large sized electrodes due to a limitation in increasing a volume of a vacuum chamber. Also, recently, there is required enlargement of not only environmental energy devices such as OLEDs and organic solar cells but also electrodes used for displays, which are seventh generation with 1870×2200 mm and eighth generation with 2200×2500 mm.

Therefore, the present invention provides a method for manufacturing an aluminum precursor solution and a method for coating using the same to manufacture an aluminum electrode using a solution process, whose electrical properties are competitive with those of aluminum electrodes manufactured by a vacuum evaporation, which is capable of being applied to a large area.

SUMMARY OF THE INVENTION

The present invention provides a method for manufacturing an aluminum electrode using a solution process.

The present invention also provides an aluminum electrode manufactured using the method.

According to an aspect of the present invention, there is provided a method for manufacturing an aluminum electrode using a solution process, the method including: manufacturing an aluminum precursor solution (Step 1); coating a substrate with the precursor solution (Step 2); and thermally treating the coated substrate at a low temperature of 80 to 150° C. (Step 3).

According to another aspect of the present invention, there is provided an aluminum electrode manufactured using the method.

BRIEF DESCRIPTION OF THE DRAWINGS

The above and/or other aspects of what is described herein will be more apparent by describing certain exemplary embodiments with reference to the accompanying drawings, in which.

DETAILED DESCRIPTION OF EXEMPLARY EMBODIMENTS

Figure 1:
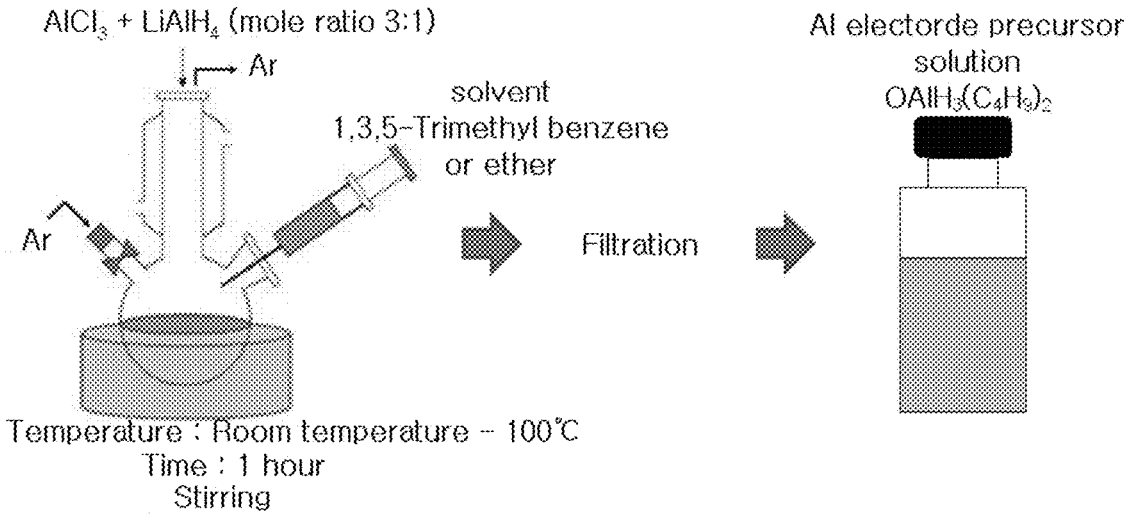
FIG. 1 is a view illustrating a process of manufacturing an aluminum precursor solution.
Figure 2:
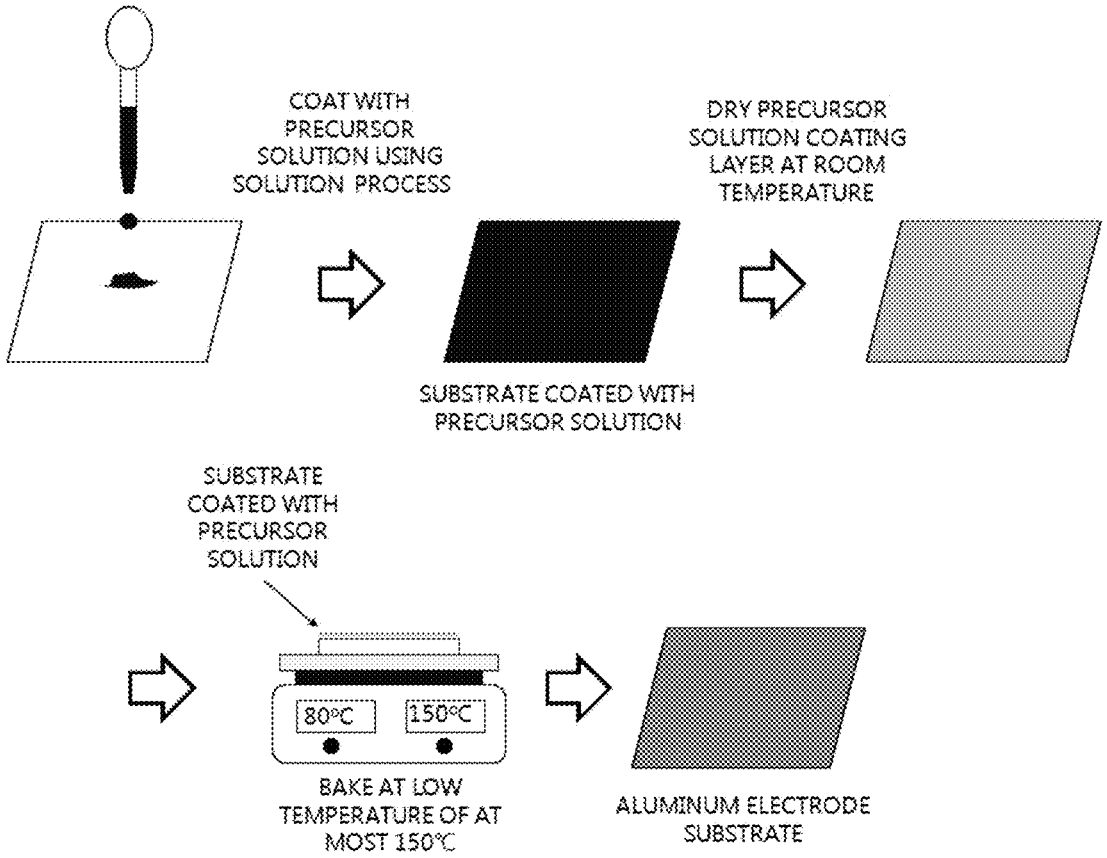
FIG. 2 is a view illustrating a process of forming an aluminum electrode on an inorganic material surface according to an embodiment of the present invention.
Figure 3:
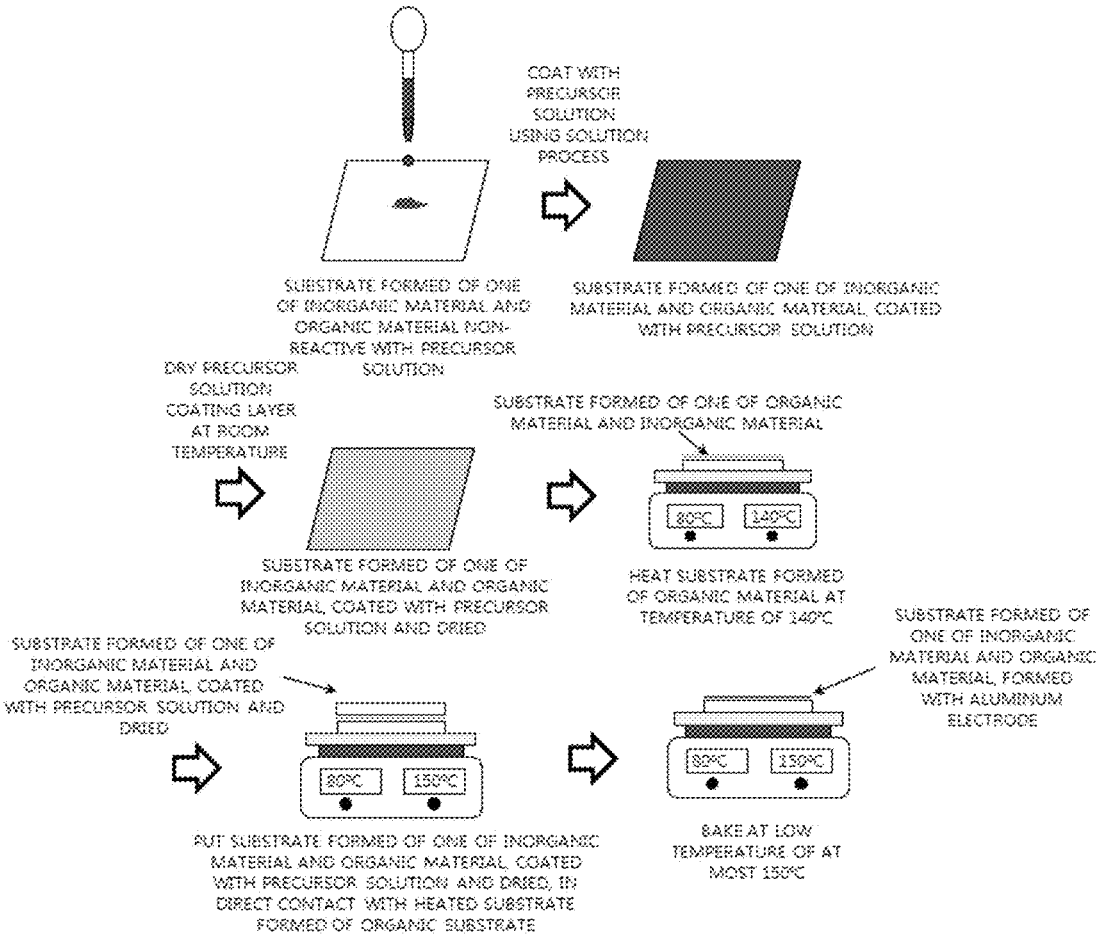
FIG. 3 is a view illustrating a process of forming an aluminum electrode on one of an organic material surface and an inorganic material surface according to another embodiment of the present invention.

Hereinafter, the present invention will be described in detail.

According to an embodiment of the present invention, there is provided a method for manufacturing an aluminum electrode using a solution process, the method including: manufacturing an aluminum precursor solution (Step 1); coating a substrate with the precursor solution (Step 2); and thermally treating the coated substrate at a low temperature of 80 to 150 (Step 3).

Hereinafter, steps of the present embodiment will be described in detail.

Step 1 is a process of manufacturing an aluminum precursor solution. The aluminum precursor solution is allowed to form an aluminum electrode using a solution process. The aluminum precursor solution may be manufactured blending aluminum chloride $AlCl_3$ with lithium aluminum hydride $LiAlH_4$ at a mole ratio of 1:3. The aluminum precursor solution is manufactured through a reaction as following Reaction Formula 1

$$AlCl_3+3LiAlH_4 \rightarrow 4AlH_3+3LiCl \qquad \text{<Reaction Formula 1>}$$

As shown in the Reaction Formula 1, $AlCl_3$ is mixed with $LiAlH_4$ at a mole ratio of 1:3, thereby generating AlH3 and LiCl.

A solvent used in Step 1 may have a boiling point of 150° C. or less. To use an aluminum precursor solution as a material of a cathode of environmental energy devices such as organic solar cell and OLEDs, it is required to form an aluminum electrode through a low-temperature baking process at the temperature of at most 150 in which organic material substrates such as electron injection layers, on which the aluminum electrode is formed, are thermally safe. As the solvent, 1,3,5-trimetylbenzene and Ether organic solvent may be used, which has a suitable boiling point and thermal decomposition point depending on a temperature for generating aluminum and a temperature for forming an electrode.

In Step 1, $AlCl_3$ and $LiAlH_4$ may be put into the solvent to be supersaturated. When putting $AlCl_3$ and $LiAlH_4$ as a base material to be supersaturated, an equilibrium moves right in the Reaction Formula 1, thereby generating a larger amount of $AlH_3$. Accordingly, to more easily and quickly form an aluminum electrode, it is required to put $AlCl_3$ and $LiAlH_4$ into the solvent to be supersaturated. A selected solvent is put thereinto and stirred and reacted for one hour at room temperature to a temperature of 100° C., thereby manufacturing an aluminum precursor solution. In this case, the reaction may be performed under an argon atmosphere to prevent aluminum from being oxidized.

With respect to Step 1, when using dibutyl ether as a solvent, for example, a solution whose reaction is completed includes a solution $H_3AlO(C_4H_9)_2$ containing $AlH_3$ and precipitate LiCl. When filtering the same, there is obtained $H_3AlO(C_4H_9)_2$, which is an aluminum precursor solution.

Step 2 is a process of coating a substrate with the precursor solution. The substrate may be coated with the aluminum precursor solution using one of spin coating, dip coating, spray coating, inkjet printing, roll coating, drop casting, and doctor blade coating. However, a method for coating a substrate with an aluminum precursor solution is not limited thereto. After the coating is completed, the substrate is dried at room temperature. Step 2 may also be performed under an argon atmosphere in order to prevent aluminum from being oxidized.

Step 3 is a process of thermally treating the coated substrate at a low temperature of 80 to 150. The substrate coated and dried in Step 2 is put on a device capable of thermally treating such as a hot plate and heated at a temperature of 80 to 150. The thermal treatment may be performed slowly increasing a heat temperature. Particularly, when the heat temperature is higher than 120 and a thermal treatment device previously heated is used, a part of an aluminum electrode layer is carbonized to be black, which requires special attention. To prevent aluminum from being oxidized, the thermal treatment in Step 3 may be performed under an argon atmosphere.

A reaction during the thermal treatment at a low temperature is performed as following Reaction Formula 2.

$$4AlH_3 \rightarrow 4Al(s)+6H_2(g) \qquad \text{<Reaction Formula 2>}$$

For example, when dibutylether is used as a solvent, by gradual heating, $O(C_4H_9)_2$ is removed from drying $H_3AlO(C_4H_9)_2$ layer, in which hydrogen concurrently falls off from $AlH_3$, thereby leaving an aluminum layer. In this case, when putting the substrate where the $H_3AlO(C_4H_9)_2$ layer is formed on, on the hot plate previously heated, the $H_3AlO(C_4H_9)_2$ layer is evaporated before forming the aluminum layer or it is impossible to form an uniform electrode due to the carbonization of a part of an organic solvent. To form an aluminum layer, the substrate where the $H_3AlO(C_4H_9)_2$ layer is formed on may be on a hot plate at room temperature and heated at a temperature 80 to 150° C.

According to another embodiment of the present invention, there is provided a method for manufacturing an aluminum electrode using a solution process, the method including: manufacturing an aluminum precursor solution (Step A); coating a substrate formed of one of an inorganic material and an organic material non-reactive with a precursor material with the aluminum precursor solution (Step B); heating a substrate formed of one of an organic material and an inorganic material, which is to be coated, at a temperature of 80 to 150° C. (Step C); and putting and thermally treating the substrate coated in Step B on the substrate formed of one of an organic material and an inorganic material, heated in Step C, at a low temperature of 80 to 150° C. and removing the substrate formed of one of an inorganic material and an organic material non-reactive with a precursor material (Step D).

Hereinafter, steps of the present embodiment will be described in detail.

Step A is performed the same as Step 1.

Step B is a process of coating a substrate formed of one of an inorganic material and an organic material non-reactive with a precursor material with the aluminum precursor solution. When a surface on which an electrode is formed is formed of an organic material, and particularly formed of a material reactive with a solvent used for manufacturing a precursor solution, the substrate may react with the precursor solution and cause a defect on the substrate. Accordingly, it is important to prevent a direct contact between a precursor solution and a substrate where an electrode is to be formed on. Therefore, it is required to use a substrate formed of one of an inorganic material and an organic material non-reactive with a precursor solution. Also, Step B may be performed under an argon atmosphere in order to prevent aluminum from being oxidized.

The coating in Step B may be performed using one of spin coating, dip coating, spray coating, inkjet printing, roll coating, drop casting, and doctor blade coating the aluminum precursor solution manufactured in Step A. However, a method for coating a substrate with an aluminum precursor solution is not limited thereto. After the coating is completed, the substrate is dried at room temperature.

Step C is a process of heating a substrate formed of one of an organic material and inorganic material, which is to be coated, at a temperature of 80 to 150. The substrate on whose surface an electrode is to be formed is put on a thermal treatment device such as a hot plate and heated at a temperature of 80 to 150 while the surface thereof is upward. Step C may be performed under an argon atmosphere to prevent aluminum from being oxidized.

Step D is a process of putting and thermally treating the substrate coated in Step B on the substrate formed of one of an organic material and an inorganic material, heated in Step C, at a low temperature of 80 to 150 and removing the substrate formed of one of an inorganic material and an organic material non-reactive with a precursor material. When a surface of the substrate coated with the precursor solution and dried is in contact with a surface of the substrate formed of one of an organic material and an inorganic material, heated in Step C, which is to be coated, a solvent is removed while thermally decomposed and hydrogen is separated from $AlH_3$ as shown in Reaction Formula 2, thereby forming an Al layer on the substrate formed of an organic material. Since there is formed aluminum powder from a precursor solution coating layer in contact with the surface formed of an organic material, an aluminum electrode layer is formed on the substrate formed of one of an organic material and an inorganic material, opposite to the substrate formed of one of an inorganic material and an organic material non-reactive with a precursor material, which is coated with the precursor solution and dried. Step D may also be performed under an argon atmosphere in order to prevent aluminum from being oxidized.

Also, Steps C and D may solve a difficulty that may occur while heating the substrate coated with an aluminum precursor solution to form an aluminum electrode in Step 3, the difficulty of forming a uniform electrode due to the evaporation of a coating layer and the carbonization of an organic solvent forming the coating layer when thermally treating the substrate at a temperature higher than 120 on a thermal treatment device previously heated.

In addition, according to still another embodiment of the present invention, there is provided a method for manufacturing an aluminum electrode using a solution process, the method including: manufacturing an aluminum precursor solution (Step a); putting a fiber medium coated with the aluminum precursor solution on a first substrate (Step b); heating a second substrate for forming an electrode at a temperature of 80 to 150° C. (Step c); and putting and thermally treating the first substrate on the heated substrate at a low temperature of 80 to 150° C. and removing the first substrate and the fiber medium coated with the precursor solution (Step d).

Step a is performed the same as Step 1.

Step b is a process of putting a fiber medium coated with the aluminum precursor solution on a first substrate. For example, the fiber medium may be paper. Since the fiber medium may absorb a large amount of an aluminum precursor solution, different from a substrate, it is possible to form a thickness of an aluminum electrode, depending on an amount of the absorbed aluminum precursor solution. Also, since an absorption amount of the same material is the same, it is possible to form an aluminum electrode with a uniform thickness. The aluminum precursor solution is put on the first substrate and dried at room temperature. Step b may also be performed under an argon atmosphere in order to prevent aluminum from being oxidized.

Step c is a process of heating a second substrate for forming an electrode at a temperature of 80 to 150° C. The substrate on whose surface an electrode is to be formed is put on a thermal treatment device such as a hot plate and heated at a temperature of 80 to 150 while the surface thereof is upward. Step c may also be performed under an argon atmosphere to prevent aluminum from being oxidized.

Step d is a process of putting and thermally treating the first substrate on the heated substrate at a low temperature of 80 to 150° C. and removing the first substrate and the fiber medium coated with the precursor solution. When the first substrate where the fiber medium coated with the precursor solution is attached is in contact with the surface of the second substrate, which is to be coated, a solvent is thermally decomposed and removed, and as shown in Reaction Formula 2, hydrogen is separated from $AlH_3$ and an Al layer is formed on the second substrate. Since aluminum powder is formed from a precursor solution coating layer in contact with the second substrate, the Al layer is formed on the second substrate opposite from the first substrate. Step d may also be performed under an argon atmosphere in order to prevent aluminum from being oxidized.

In addition, according to an embodiment of the present invention, there is provided an aluminum electrode manufactured using the method for manufacturing an aluminum electrode using a solution process.

The aluminum electrode may be manufactured using a solution process of thermally treating through a low-temperature baking process at the temperature of at most 150° C. in a short time, thereby solving a thermal defect of an electrode, occurring due to general high-temperature baking processes. Also, it is possible to prevent excessive loss of raw material and to form an electrode under atmospheric pressure, thereby reducing a charge for manufacturing and maintaining. Also, it is possible to manufacture aluminum electrodes with various sizes from a small size to a large size. Also, the aluminum electrode has the same or higher properties as those of general organic solar cells requiring a low work function electrode and OLED cathodes.

Examples of the present invention will now be described in further detail below. It would be obvious to those skilled in the art that these examples are intended to be more concretely illustrative and the scope of the present invention as set forth in the appended claims is not limited to or by the examples.

<Embodiment 1> Manufacturing an Aluminum Electrode on a Glass Substrate ( )

Step 1. Manufacturing an Aluminum Precursor Solution

To allow the mole ratio of aluminum chloride to lithium aluminum hydride to be 1:3, 0.133 g of aluminum chloride $AlCl_3$ and 0.114 g of lithium aluminum hydride $LiAlH_4$ was put into a flask with three inlets and a reflux condenser and heated and stirred at a temperature of 80° C. for one hour under an argon atmosphere using 100 ml of dibutyl ether as a solvent. Compounds were LiCl and $AlH_3$ and LiCl was filtered and removed, thereby manufacturing an aluminum precursor solution $OAlH_3(C_4H_9)_2$ in which $AlH_3$ was dissolved in a solvent.

Step 2. Coating a Substrate with a Precursor Solution

An amorphous glass substrate was coated with the aluminum precursor solution manufactured in Step 1 by dipping therein and dried.

Step 3. Thermally Treatment at a Low Temperature

The substrate coated and dried in Step 2 was put on a hot plate at room temperature and heated to 140° C., thereby manufacturing an aluminum electrode.

<Embodiment 2> Manufacturing an Aluminum Electrode on a Glass Substrate (II)

Step 1. Manufacturing an Aluminum Precursor Solution

An aluminum precursor solution was manufactured by performing the same as that of Step 1 of Embodiment 1.

Step 2. Coating a Substrate with the Aluminum Precursor Solution

An aluminum precursor solution layer was formed on a glass substrate by performing the same as that of Step 2 of Embodiment 2.

Step 3. Heating a Substrate Formed of an Inorganic Material

A glass substrate where an electrode was to be formed was put on a hot plate and heated to 140° C.

Step 4. Forming an Aluminum Electrode on the Substrate Formed of an Inorganic Material A surface of the substrate of Step 2, coated with the aluminum precursor solution, was put downward on the glass substrate heated in Step 3, whose top was to be coated, and heated at a temperature of 140° C. for one minute, thereby manufacturing an aluminum electrode on the glass substrate.

<Embodiment 3> Manufacturing an Aluminum Electrode on a Substrate Formed of an Organic Material Step 1. Manufacturing an Aluminum Precursor Solution An aluminum precursor solution was manufactured by performing the same as that of Step 1 of Embodiment 1.

Step 2. Coating a Substrate with the Aluminum Precursor Solution

A glass substrate was coated with the aluminum precursor solution by dipping therein and dried.

Step 3. Heating a Substrate Formed of an Organic Material

A polyethylene substrate where an electrode was to be formed was put on a hot plate and heated at a temperature of 140° C.

Step 4. Forming an Aluminum Electrode on the Substrate Formed of an Organic Material A surface of the substrate of Step 2, coated with the aluminum precursor solution, was put downward on the polyethylene substrate heated in Step 3, whose top was to be coated, and heated at a temperature of 140° C. for one minute, thereby manufacturing an aluminum electrode on the polyethylene substrate.

<Embodiment 4> Manufacturing a Thick Aluminum Electrode

Step 1. Manufacturing an Aluminum Precursor Solution

An aluminum precursor solution was manufactured by performing the same as that of Step 1 of Embodiment 1.

Step 2. Coating a Piece of Paper with the Aluminum Precursor Solution

A piece of paper was coated with the aluminum precursor solution manufactured in Step 1, put on a first substrate formed of glass, and dried.

Step 3. Heating a Substrate

A second glass substrate where an electrode was to be formed was put on a hot plate and heated at a temperature of 140° C.

Step 4. Forming an Aluminum Electrode on the Glass Substrate

The first glass substrate where the piece of paper coated with the aluminum precursor solution and dried in Step 2 was attached to was put on the second glass substrate heated in Step 3 and heated at a temperature of 140° C. for three minutes, thereby manufacturing an aluminum electrode with a thickness of 263 nm.

<Experimental Example 1> Visual Observation on the Manufactured Electrode

Figure 4:
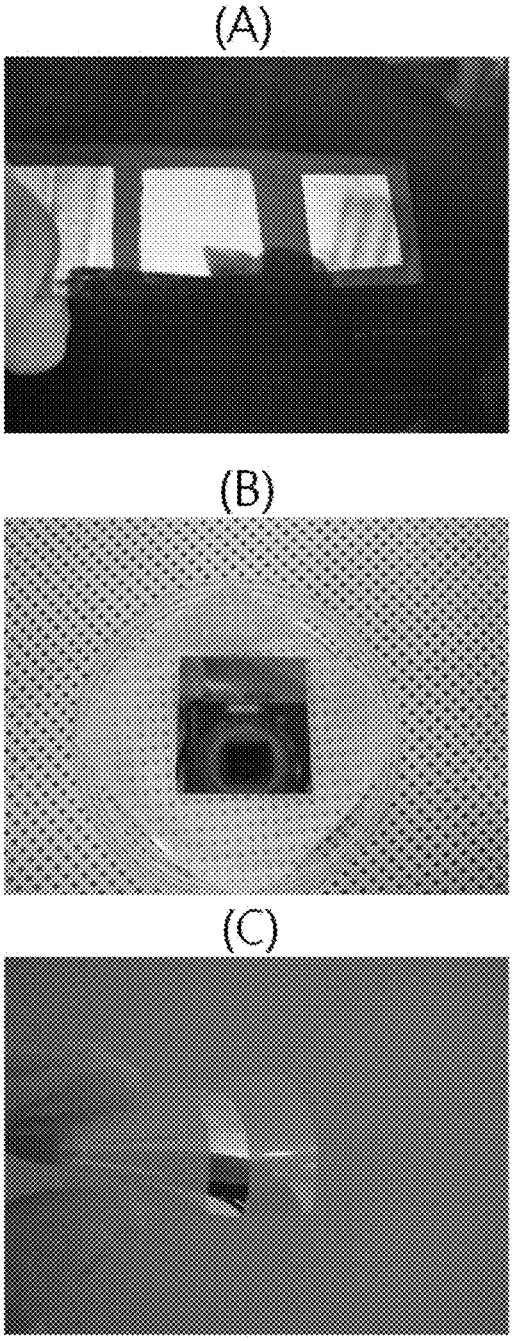
FIG. 4 illustrates pictures of aluminum electrodes manufactured in Embodiment 1, Embodiment 2, and Embodiment 3.

To check external properties, the aluminum electrodes manufactured in Embodiment 1, Embodiment 2, and Embodiment 3 were observed by naked eyes and a result thereof were shown in FIG. 4.

Referring to FIG. 4, aluminum electrodes were manufactured on amorphous glass substrates in Embodiment 1 and Embodiment 2 and a polyethylene substrate in Embodiment 3, and as a result thereof, it was possible to know that aluminum films uniformly coated and coated metal layers had very high reflectance as a reflecting plate. Also, there was no defect such as a detachment in the aluminum electrode film manufactured on the polyethylene substrate, which had flexibility as that of the polyethylene substrate.

<Experimental Example 2> XRD Analysis

Figure 5:
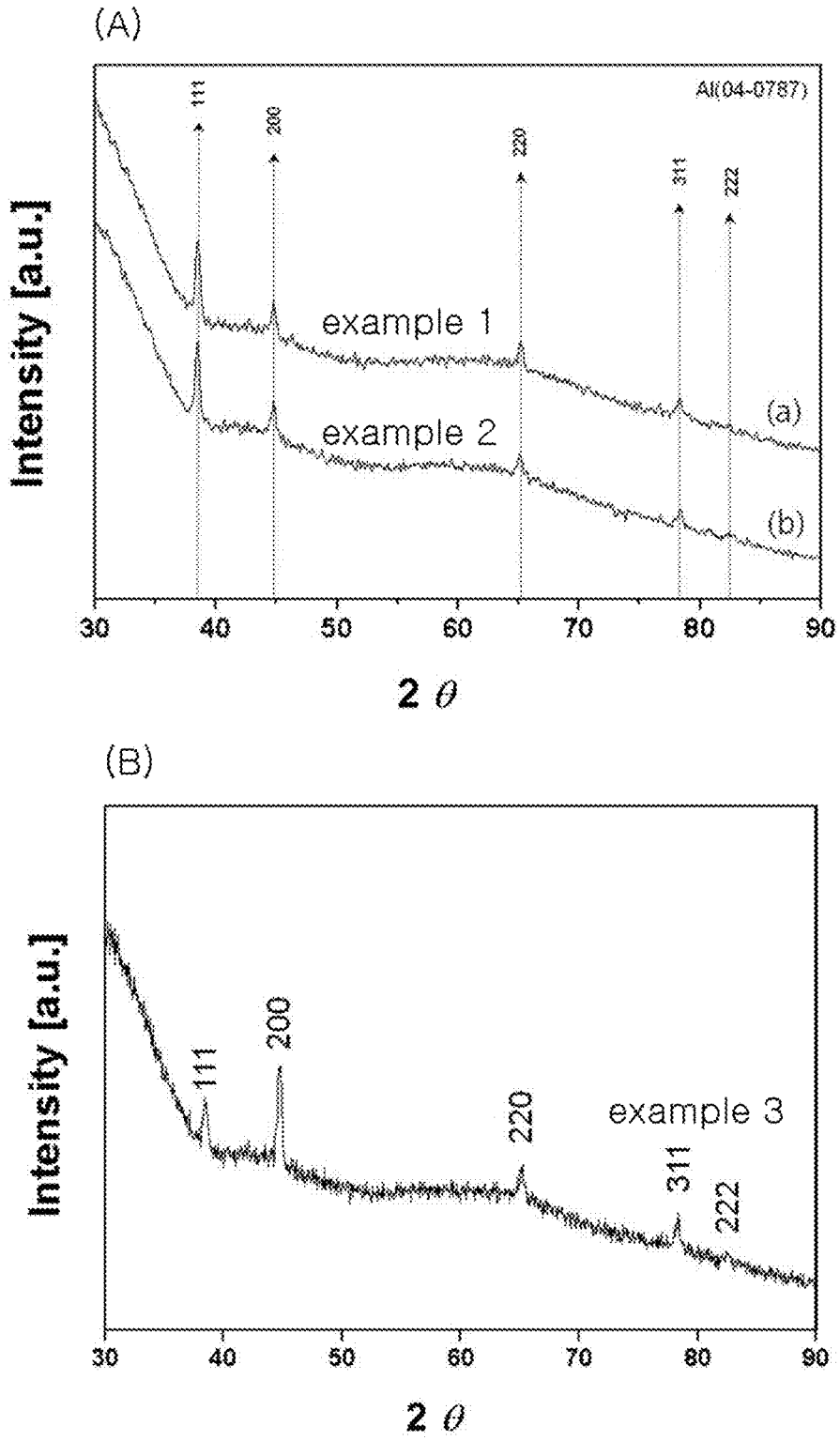
FIG. 5 illustrates graphs illustrating results of X-ray diffraction (XRD) of the aluminum electrodes shown in FIG. 4.

To investigate crystallizability of aluminum, an X-ray diffraction (XRD) analysis was performed with respect to the aluminum electrodes manufactured in Embodiment 1, Embodiment 2, and Embodiment 3 and a result thereof were shown in FIG. 5.

Referring to FIG. 5, it was possible to know that XRD patterns of the manufactured electrodes were identical to a face centered cubic (FCC) structure according to JSPDS card Al(04-0407). Therefore, it was possible to know that AlH3 contained in the aluminum precursor solution manufactured using the method according to the embodiments of the present invention was very effective to form an aluminum layer.

<Experimental Example 3> SEM Pictures Analysis

Figure 6:
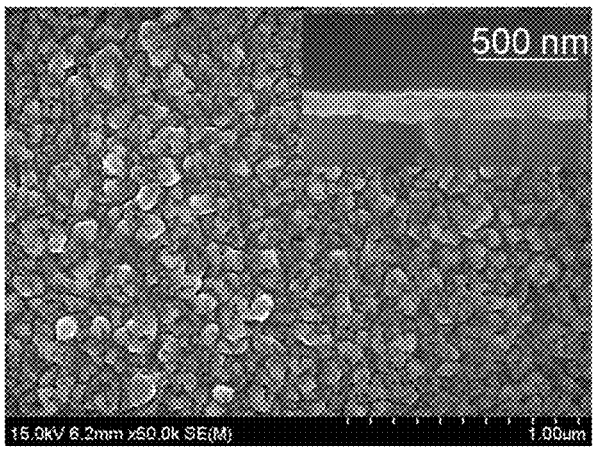
FIG. 6 illustrates scanning electron microscope (SEM) pictures of the aluminum electrodes.
Figure 6:
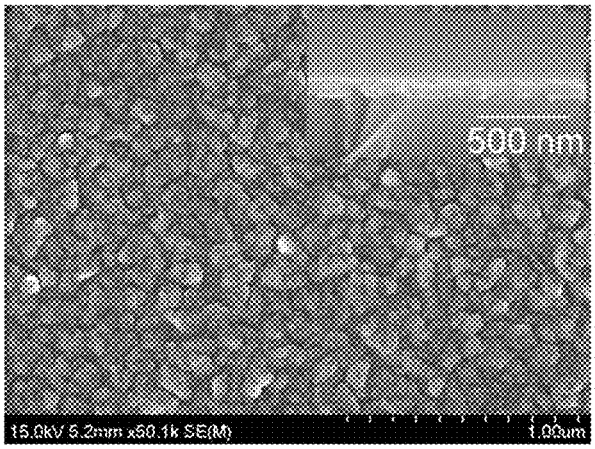
Figure 6:
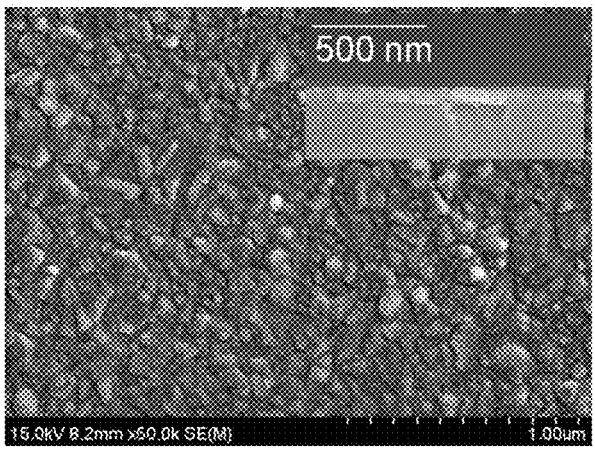

To check a microstructure and thickness of aluminum layers formed on the aluminum electrodes manufactured in Embodiment 1, Embodiment 2, and Embodiment 3, a scanning electron microscope (SEM) was used and a result thereof was shown in FIG. 6.

Referring to FIG. 6, there was rarely formed air hole on the surface of the aluminum layers, which has a dense structure. Also, as a result of observe the cross-section of the electrodes, it was possible to know that thicknesses of the electrodes formed on glass substrates in A (Embodiment 1) and B (Embodiment 2) and a polyethylene substrate in C (Embodiment 3) were 117 nm, 102 nm, and 70 nm, respectively. Also, referring to SEM pictures of Embodiments 1 to 3, it may be known that the manufactured aluminum electrodes are in the shape of a thin film with a dense structure. Since the density of an electrode is required to improve electrical properties thereof, the result as described above allows it to be estimated that the aluminum electrodes manufactured according to the present invention have excellent electrical properties.

<Experimental Example 4> Measuring Resistivity

Figure 7:
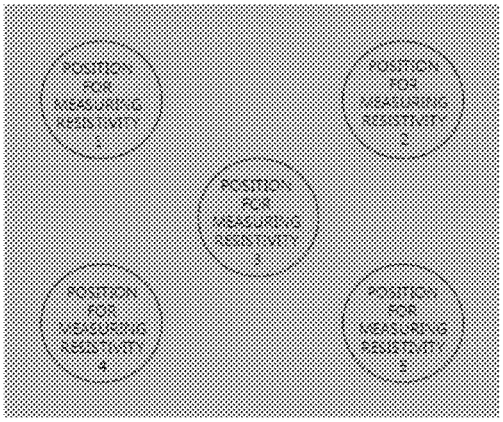
FIG. 7 illustrates graphs illustrating resistivity of the aluminum electrodes in different positions.
Figure 7:
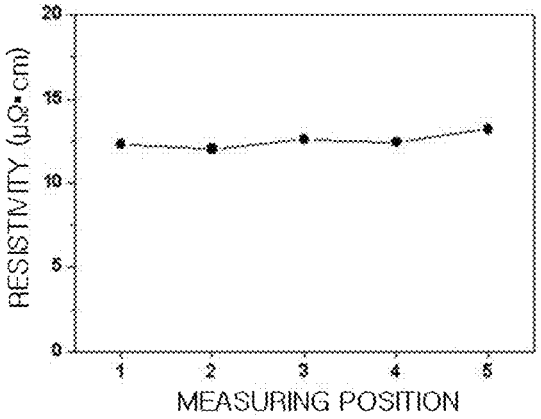
Figure 7:
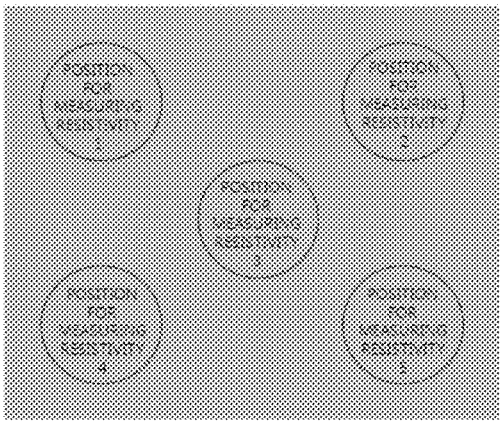
Figure 7:
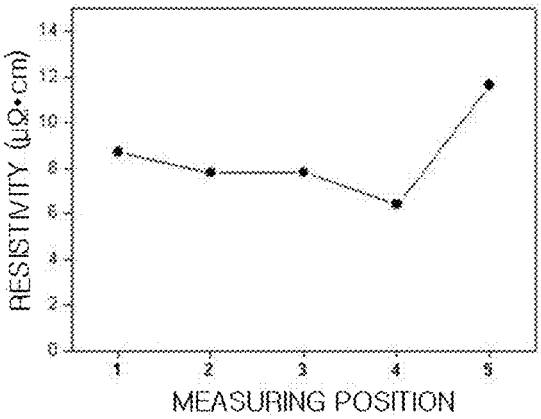
Figure 7:
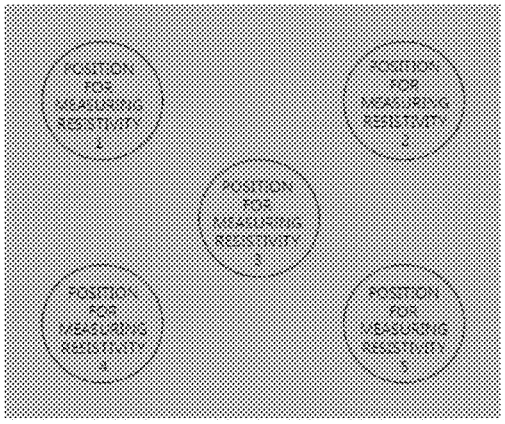
Figure 7:
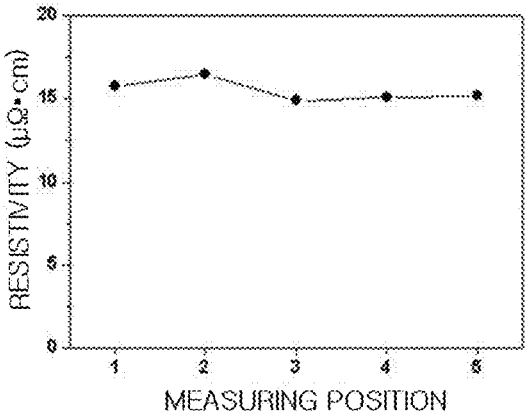

To check resistivity depending on a position thereof, the resistivity of the aluminum electrodes manufactured in Embodiment 1, Embodiment 2, and Embodiment 3 was measured using 4 point probe method and a result thereof was shown in FIG. 7.

Referring to FIG. 7, respective positions where resistivity was measured and the resistivity of the respective positions were shown in graphs. The mean resistivity values of the aluminum electrodes manufactured in Embodiment 1, Embodiment 2, and Embodiment 3 in five positions were 12.52 μΩ·cm, 8.49 μΩ·cm, and 15.53 μΩ·cm, respectively, which were relatively low. The standard deviation depending on the position of the respective electrodes were 0.46 μΩ·cm, 1.74 μΩ·cm, and 0.65 μΩ·cm, which indicates that electrical properties of the electrodes were very excellent and uniform.

The foregoing exemplary embodiments and advantages are merely exemplary and are not to be construed as limiting the present invention. The present teaching can be readily applied to other types of apparatuses. Also, the description of the exemplary embodiments of the present inventive concept is intended to be illustrative, and not to limit the scope of the claims, and many alternatives, modifications, and variations will be apparent to those skilled in the art.

The invention claimed is:

1. A method for manufacturing an aluminum electrode using a solution process, the method comprising:

manufacturing a solution containing an aluminum precursor (Step A);

coating a first substrate formed of one of an inorganic material and an organic material non-reactive with the solution containing an aluminum precursor, with the solution containing an aluminum precursor (Step B);

heating a second substrate formed of one of an organic material and an inorganic material, where an aluminum thin film electrode is to be formed, at a temperature of 80 to 150° C. (Step C); and after Step C, heating a coated layer through the heated second substrate, by contacting the coated layer on the first substrate with the second substrate heated in Step C, and removing the first substrate (Step D), wherein the aluminum electrode is formed on the surface of the second substrate, wherein a solvent used in Step A has a boiling point of at most 150° C., and wherein the aluminum precursor in Step A comprises $AlH_3$.

2. The method of claim 1, wherein the coating in Step B is performed by one selected from the group consisting of spin coating, dip coating, spray coating, inkjet printing, roll coating, drop casting, and doctor blade coating.

3. The method of claim 1, wherein Step A is performed mixing $AlCl_3$ with $LiAlH_4$ at a mole ratio of 1:3.

4. The method of claim 1, wherein the first substrate in Step B comprises a fiber medium.

* * * * *